US008860708B2

(12) United States Patent
Routley et al.

(10) Patent No.: US 8,860,708 B2
(45) Date of Patent: Oct. 14, 2014

(54) ACTIVE MATRIX DISPLAY DRIVE CONTROL SYSTEMS

(75) Inventors: Paul R. Routley, Cambridge (GB); Euan C. Smith, Cambridgeshire (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 1680 days.

(21) Appl. No.: 12/065,575

(22) PCT Filed: Aug. 25, 2006

(86) PCT No.: PCT/GB2006/003171

§ 371 (c)(1),
(2), (4) Date: Aug. 5, 2008

(87) PCT Pub. No.: WO2007/031704

PCT Pub. Date: Mar. 22, 2007

(65) Prior Publication Data

US 2009/0201281 A1 Aug. 13, 2009

(30) Foreign Application Priority Data

Sep. 12, 2005 (GB) ..... 0518541.8

(51) Int. Cl.
*G09G 5/00* (2006.01)
*G09G 3/32* (2006.01)

(52) U.S. Cl.
CPC ..... *G09G 3/3233* (2013.01); *G09G 2330/021* (2013.01); *G09G 2320/043* (2013.01); *G09G 2320/029* (2013.01); *G09G 2300/0842* (2013.01); *G09G 2310/027* (2013.01)
USPC ..... 345/212; 345/82; 345/211

(58) Field of Classification Search
USPC ..... 345/82, 211, 212
See application file for complete search history.

(56) References Cited

U.S. PATENT DOCUMENTS

| | | | | |
|---|---|---|---|---|
| 4,539,507 | A | 9/1985 | VanSlyke et al. | |
| 5,220,315 | A * | 6/1993 | Clerc | 345/93 |
| 2003/0122813 | A1 | 7/2003 | Ishizuki et al. | |
| 2004/0246241 | A1 * | 12/2004 | Sato et al. | 345/204 |
| 2004/0263444 | A1 | 12/2004 | Kimura | |
| 2005/0057191 | A1 * | 3/2005 | Jo et al. | 315/291 |
| 2005/0068270 | A1 * | 3/2005 | Awakura et al. | 345/76 |

FOREIGN PATENT DOCUMENTS

| | | | |
|---|---|---|---|
| EP | 0 717 446 | A2 | 6/1996 |
| EP | 1 450 345 | | 8/2004 |
| GB | 2 389 951 | | 12/2003 |
| GB | 2 389 952 | A | 12/2003 |
| WO | WO-90/13148 | A1 | 11/1990 |
| WO | WO-95/06400 | A1 | 3/1995 |
| WO | WO-99/21935 | A1 | 5/1999 |
| WO | WO-99/42983 | A1 | 8/1999 |

(Continued)

OTHER PUBLICATIONS

International Search Report for PCT/GB2006/003171 dated Jan. 22, 2007.
Written Opinion for PCT/GB2006/003171 dated Jan. 22, 2007.

(Continued)

*Primary Examiner* — Premal Patel
(74) *Attorney, Agent, or Firm* — Marshall, Gerstein & Borun LLP

(57) ABSTRACT

This invention relates to methods, apparatus, and computer program code for driving an active matrix display, in particular an organic light emitting diode (OLED) display, with reduced power consumption.

23 Claims, 4 Drawing Sheets

(56) References Cited

FOREIGN PATENT DOCUMENTS

| | | | |
|---|---|---|---|
| WO | WO-99/48160 | A1 | 9/1999 |
| WO | WO-02/067343 | A1 | 8/2002 |
| WO | WO-03/107313 | A2 | 2/2003 |
| WO | WO-03/038790 | A2 | 5/2003 |

OTHER PUBLICATIONS

Combined Search and Examination Report for Application No. GB0518541.8, dated Nov. 17, 2005.
International Preliminary Report on Patentability for Application No. PCT/GB2006/003171, dated Mar. 18, 2008.

* cited by examiner

150

160

ACTIVE MATRIX DISPLAY DRIVE CONTROL SYSTEMS

BACKGROUND OF THE INVENTION

1. Field of the Invention

This invention relates to methods, apparatus, and computer program code for driving an active matrix display, in particular an organic light emitting diode (OLED) display, with reduced power consumption.

2. Related Technology

Displays fabricated using OLEDs provide a number of advantages over LCD and other flat panel technologies. They are bright, colorful, fast-switching (compared to LCDs), provide a wide viewing angle and are easy and cheap to fabricate on a variety of substrates. Organic (which here includes organometallic) LEDs may be fabricated using materials including polymers, small molecules and dendrimers, in a range of colors which depend upon the materials employed. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507.

A typical OLED device comprises two layers of organic material, one of which is a layer of light emitting material such as a light emitting polymer (LEP), oligomer or a light emitting low molecular weight material, and the other of which is a layer of a hole transporting material such as a polythiophene derivative or a polyaniline derivative.

Organic LEDs may be deposited on a substrate in a matrix of pixels to form a single or multi-color pixellated display. A multicolored display may be constructed using groups of red, green, and blue emitting pixels. So-called active matrix (AM) displays have a memory element, typically a storage capacitor and a transistor, associated with each pixel while passive matrix displays have no such memory element and instead are repetitively scanned to give the impression of a steady image. Examples of polymer and small-molecule active matrix display drivers can be found in WO 99/42983 and EP 0,717,446A respectively.

FIG. 1*a* shows such an example OLED active matrix pixel circuit 150. A circuit 150 is provided for each pixel of the display and ground 152, $V_{ss}$ 154, row select 124 and column data 126 busbars are provided interconnecting the pixels. Thus each pixel has a power and ground connection and each row of pixels has a common row select line 124 and each column of pixels has a common data line 126.

Each pixel has an organic LED 152 connected in series with a driver transistor 158 between ground and power lines 152 and 154. A gate connection 159 of driver transistor 158 is coupled to a storage capacitor 120 and a control transistor 122 couples gate 159 to column data line 126 under control of row select line 124. Transistor 122 is a thin film field effect transistor (FET) switch which connects column data line 126 to gate 159 and capacitor 120 when row select line 124 is activated. Thus when switch 122 is on a voltage on column data line 126 can be stored on a capacitor 120. This voltage is retained on the capacitor for at least the frame refresh period because of the relatively high impedances of the gate connection to driver transistor 158 and of switch transistor 122 in its "off" state.

Driver transistor 158 is typically an FET transistor and passes a (drain-source) current which is dependent upon the transistor's gate voltage less a threshold voltage. Thus the voltage at gate node 159 controls the current through OLED 152 and hence the brightness of the OLED.

The voltage-controlled circuit of FIG. 1 suffers from a number of drawbacks, and some ways to address these are described in the applicant's WO03/038790.

FIG. 1*b*, taken from WO03/038790, shows an example of a current-controlled pixel driver circuit 160 which addresses these problems. In this circuit the current through an OLED 152 is set by setting a drain source current for OLED driver transistor 158 using a reference current sink 162 and memorising the driver transistor gate voltage required for this drain-source current. Thus the brightness of OLED 152 is determined by the current, $I_{col}$, flowing into reference current sink 162, which is preferably adjustable and set as desired for the pixel being addressed. In addition, a further switching transistor 164 is connected between drive transistor 158 and OLED 152. In general one current sink 162 is provided for each column data line.

It can be seen from these examples that an active matrix pixel circuit generally incorporates a thin film (driver) transistor (TFT) in series with an electroluminescent display element.

Referring now to FIG. 2*a*, this shows drain characteristics 200 for a FET TFT driver transistor of an active matrix pixel circuit. A set of curves 202, 204, 206, 208, is shown each illustrating the variation of drain current of the FET with drain-source voltage for a particular gate-source voltage. After an initial non-linear portion of the curves become substantially flat, and the FET operates in the so-called saturation region. With increasing gate-source voltage the saturation drain current increases; below a threshold gate-source voltage $V_T$ the drain current is substantially 0. The dashed line 230 indicates the separation between the initial non-linear portion of the curves and the saturation region. For each set of curves 202, 204, 206, 208, a threshold point $V_T$(202), $V_T$(204), $V_T$(206), $V_T$(208) exists that indicates the point between the initial non-linear portion of the curve and the saturation region. Typical values of $V_T$ are between 1V and 6V. Broadly speaking the FET acts as a voltage controlled current limiter.

FIG. 2*b* shows a drive portion 240 of a typical active matrix pixel circuit. A PMOS driver FET 242 is connected in series with an organic light emitting diode 244 between a ground line 248 and a negative power line $V_{ss}$ 246.

It will be appreciated from the circuit of FIG. 2*b* that, for a given OLED drive current, the greater $V_{SS}$ the greater the excess (waste) power dissipation in driver transistor 242. It is therefore preferable to reduce $V_{SS}$ as much as possible to reduce this excess dissipated power. However it can be appreciated from FIG. 2*a* that there is a limit, as indicated by dashed line 230, below which $V_{ss}$ may not be reduced, this limit being determined by the maximum available $V_{GS}$ and the required OLED drive voltage.

In an active matrix driver multiple factors contribute to increasing the supply voltage of an AM OLED display above that which is necessary at a given time. In principal a supply voltage might only need to be ~0.5V above that required to drive the highest voltage OLED (~4V for polymer, ~7V for small molecule and phosphorescent systems). However in practice the supply needs to be sufficient to hold the drive TFT in saturation, and possess enough overhead to cope with increases in OLED threshold voltage with time which can result in supply voltages as high as 14V for small molecule. This extra voltage is dropped entirely over the drive TFT increasing (doubling in the example given) the power consumption and stressing the TFT both with the enhanced field drop and heating. We have previously described, in WO03/107313, some techniques for addressing these difficulties.

SUMMARY OF THE INVENTION

According to the present invention there is therefore provided a method of reducing the power consumption of an active matrix electroluminescent display, the method comprising: controlling a power supply voltage to the display; and monitoring a power supply current to the display; and wherein said controlling further comprises progressively reducing said power supply voltage until said power supply current reduces by greater than a threshold.

In embodiments this method provides enhanced efficiency of the display and reduced stress on the drive thin film transistor. This also helps to reduce threshold voltage drift with time. Thus, broadly speaking embodiments of the method provide reduced power consumption and/or increased display lifetime.

The current threshold may be an absolute current value threshold or a relative threshold such as a percentage (such as 90 percent) of a saturation current determined as, for example, a current value which is substantially constant for small changes in supply voltage. Alternatively the threshold may be defined in terms of a rate of reduction of supply current—that is, for example, a percentage change in supply current with a step reduction in supply voltage. In a further alternative a response curve of an active matrix pixel (drive transistor and electroluminescent display element) may be stored, for example in non-volatile memory, and the threshold determined by a position on such a characteristic curve, which may in turn be determined by the monitored power supply current.

Preferably the monitoring and controlling maintains the active matrix display in an operating region in which a highest driven driver transistor (that is, a driver transistor with a maximum drive) is just within saturation. Preferably the monitoring and controlling is performed substantially continuously, for example in a computer program controlled feedback loop.

Where the active matrix display is a multi-colored display with at least two, and preferably three sub-pixels of different colors each of the sub-pixels may be provided with a different respective power supply line so that the power supplies for the different sub-pixels may be controlled substantially independently. This is advantageous because, in general, different color sub-pixels have different threshold voltages and by driving them from separate power supply lines a separate optimisation may be supplied for each. Additionally or alternatively different spatially separate regions of the display may be provided with their own respective power supply lines for separate respective power supply control along the lines outlined above. This may be advantageous where, for example, different regions of the display are substantially dedicated to different tasks.

In embodiments the method also controls a drive level to one or more pixels of the display. This allows a further reduction in power supply voltage providing the drive level of one or more pixels, which might otherwise be brought out of saturation is increased to compensate.

In a related aspect the invention provides a controller for an active matrix electroluminescent display driver, the display having a plurality of pixels each with an electroluminescent display element and an associated drive transistor, the display having a power supply line for providing power to the driver transistors of said pixels; the driver comprising a pixel data driver to drive said display pixels with data for display, a controllable voltage power supply to provide a power supply to said power supply line, and a current sensor to sense a current in said power supply line; the controller comprising: a current sense input for said current sensor; a voltage control output for said controllable power supply; and a voltage controller to provide a voltage control signal for said voltage control output responsive to a current sense signal from said current sense input.

Preferably the voltage controller is configured to adjust the power supply control signal to progressively reduce the sensed current to a threshold point, and to then adjust the control signal to maintain the sensed current in the region of this threshold point. Generally the power supply voltage is determined with respect to a ground line of the active matrix display, although it may in principle be determined with respect to some other power supply line. Optionally the driver may include a voltage sensor to sense the power supply voltage and to provide an input to the controller which may be used, for example, to facilitate determination of an operating point of the display. In this case the control output may also be responsive to the sensed power supply voltage.

As mentioned above, the display may have a plurality of power supply lines driving different portions of the display such as different sub-pixels or different spatially separate regions of the display, in which case the controller (or separate controllers) may control the power supply voltage to each separate power supply line. Optionally, as mentioned above, the pixel drive data may be adjusted in coordination with the voltage control signal, in particular to compensate (the hardest or highest driven drive transistors) for a reduction in power supply voltage.

The invention further provides an active matrix electroluminescent display driver incorporating the above described controller in combination with the above described pixel data driver, controllable voltage power supply, and current sensor.

In all of the above aspects of the invention the electroluminescent display device preferably comprises an organic light emitting diode-based display such as a small molecule, polymer and/or dendrimer-based display.

In a further aspect the invention provides an active matrix OLED display wherein each said pixel comprises at least first and second sub-pixels of different colors, and wherein said two portions comprises said first and second sub-pixels respectively.

The invention further provides a carrier medium carrying processor control code to implement the above described methods and display drivers. This code may comprise conventional program code, for example source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog (Trade Mark) or VHDL (Very high speed integrated circuit Hardware Description Language). Such code may be distributed between a plurality of coupled components. The carrier medium may comprise any conventional storage medium such as a disk or programmed memory (for example firmware such as Flash RAM or ROM), or a data carrier such as an optical or electrical signal carrier.

BRIEF DESCRIPTION OF THE DRAWINGS

These and other aspects of the of the invention will now be further described, by way of example only, with the reference to the accompanying figures in which.

DETAILED DESCRIPTION

Broadly speaking we will describe a technique for reducing power consumption of an active matrix OLED display by means of active monitoring and adjustment of the supply voltage. In outline, test reductions of the supply voltage are made and the current drawn monitored. The voltage at which the current starts to dip significantly is the point at which the highest driven TFT is just within saturation. If the supply voltage is then held at this point then no additional allowance in supply voltage need be made for OLED ageing (and/or temperature effects) and/or possible TFT process/characteristic variations. In embodiments the active supply monitoring automatically compensates for this over time resulting in lower stresses on the TFTs and a reduced power consumption.

In some preferred embodiments these advantages are enhanced by providing separate monitors and adjustments on red, green and blue sub-pixel power supply lines. This is because the operational voltages of each color can differ considerably—for example a red sub-pixel may require a drive voltage of 3.6V while a green sub-pixel may require 4.2V and a blue sub-pixel 5.15V in which case a power supply voltage of at least 6.15V (allowing 1V overhead for driver transistor compliance and other losses) might be needed were only a single power supply line used. Alternatively, where two of the sub-pixel colors have a similar IV characteristic (for example the red and green sub-pixels) and only one differs (for example the blue sub-pixel then two rather than three sub-pixel power supplies may be provided). This can simplify electrode line routing on the display glass (substrate), sometimes significantly.

Additionally or alternatively sub-sections of the display may be supplied and monitored separately in applications where peak luminescences and thus drive levels, can vary significantly (and systematically) between different areas of the display, thus enabling further savings to be made.

In addition to the above techniques it can also be possible to drop the supply voltage further and compensate the lower OLED drive currents on some of the drive transistors by increasing the corresponding gate voltages in response. Preferably this is done with knowledge of the (average) electrical characteristics of the drive transistors, so that this information (in effect a graph) can be used to determine an increase in gate voltage needed to compensate a particular supply voltage reduction. Such characteristics may, for example, be stored in non-volatile memory in the driver.

Figure 1A:
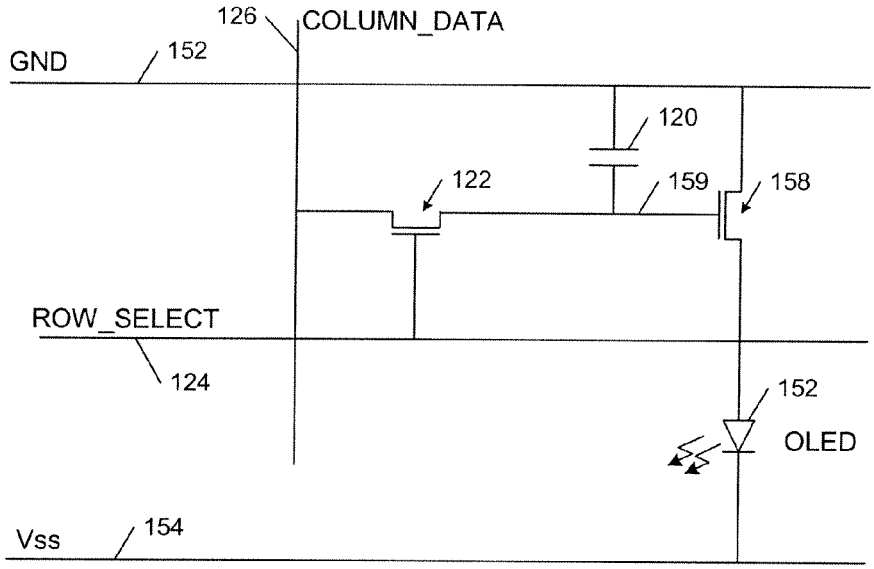
Figure 1a (PRIOR ART)
FIG. 1 shows an example of an active matrix OLED pixel circuit.
Figure 1B:
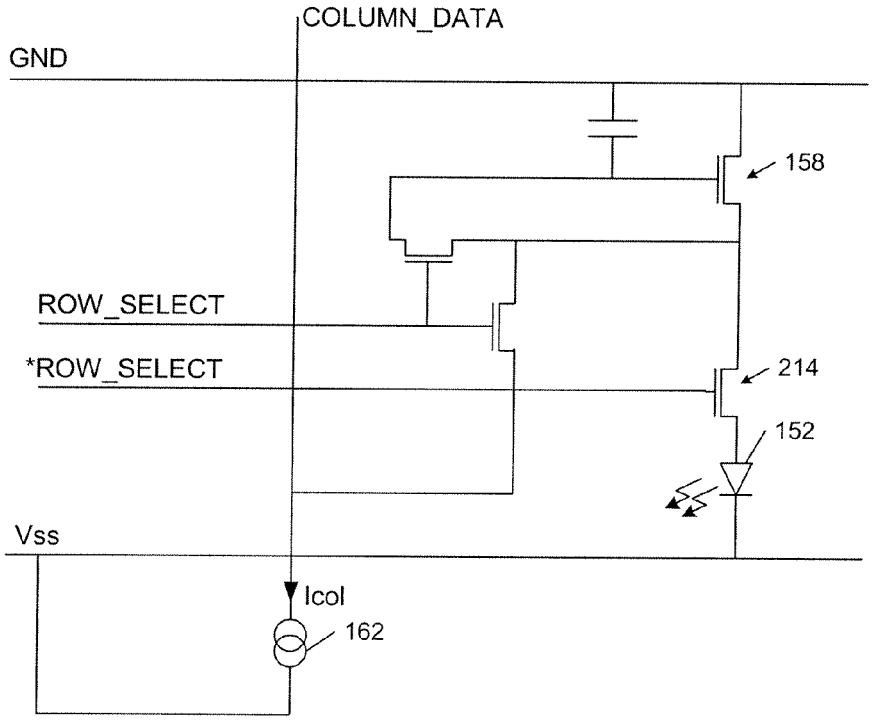
Figure 1b (PRIOR ART)
Figure 2A:
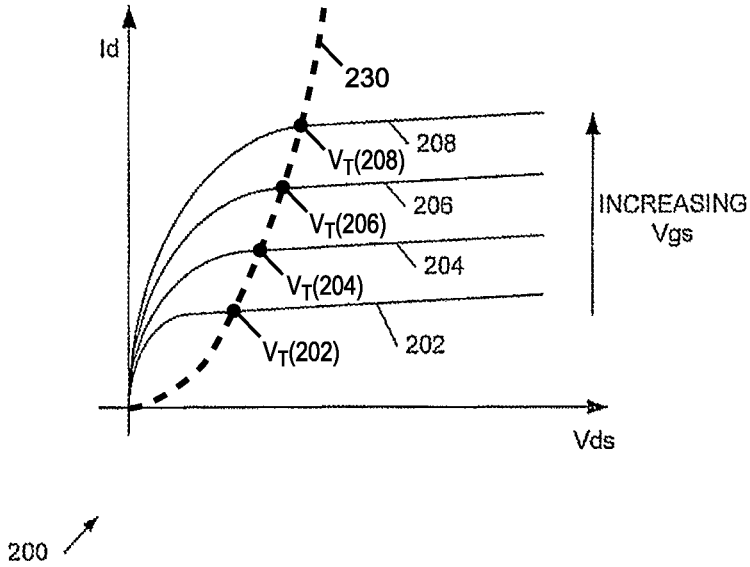
Figure 2a Prior Art
FIGS. 2*a* and 2*b* show, respectively drain characteristics for a TFT driver transistor of an active matrix pixel circuit, and a drive portion of a generalised active matrix pixel circuit.
Figure 2B:
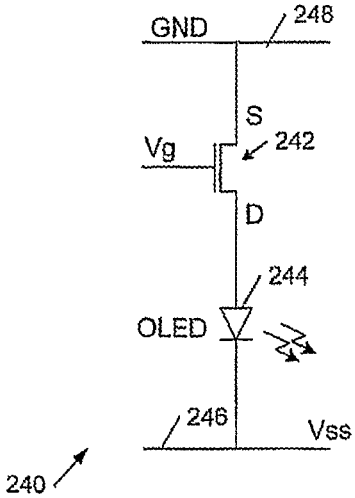
Figure 2b Prior Art
Figure 3:
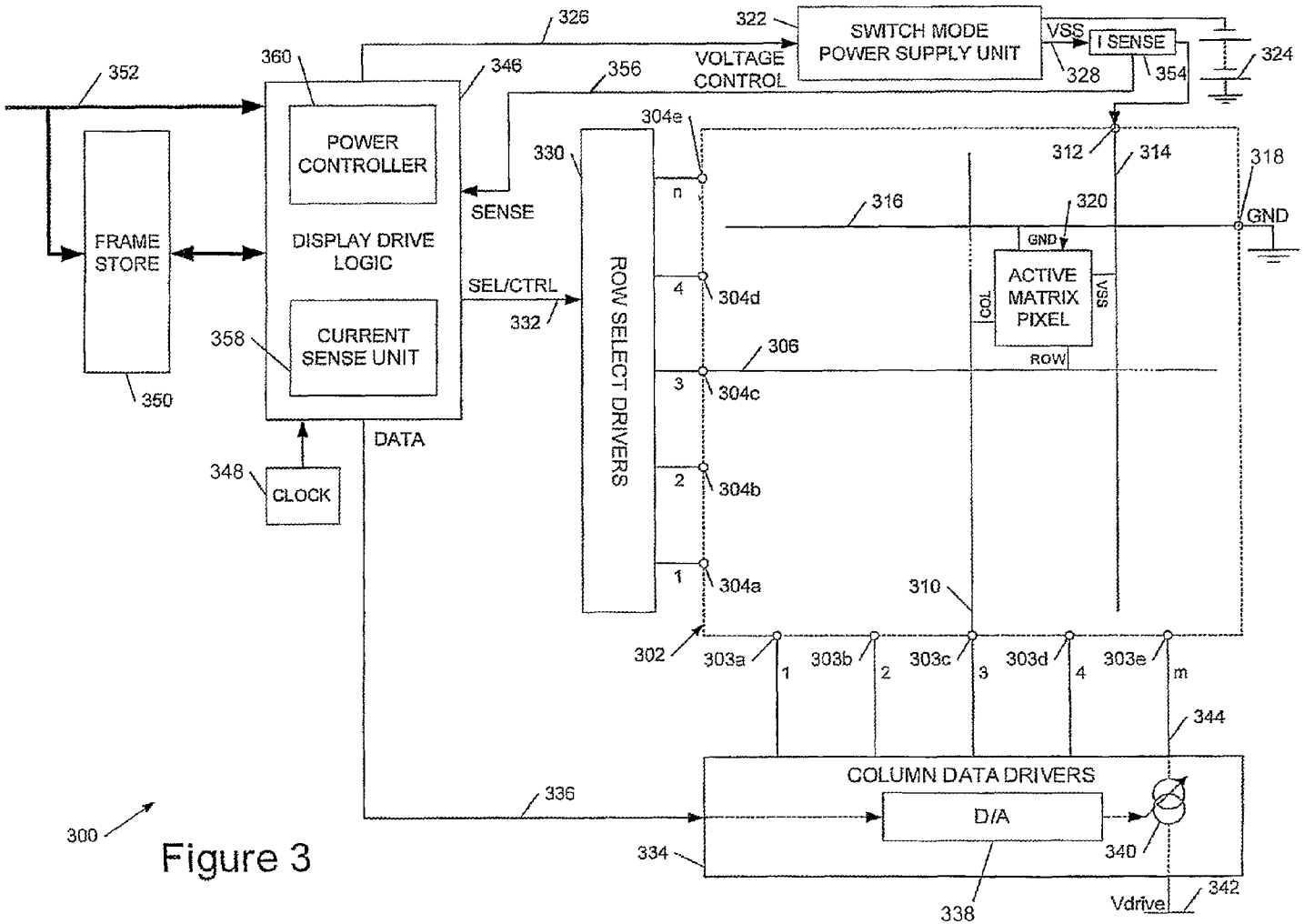
FIG. 3 shows an active matrix display driver according to an embodiment of the present invention.

FIG. 3 shows a block diagram 300 of a display driver for an active matrix display 302, configured to control $V_{ss}$ in accordance with the available active matrix pixel drive voltage to increase the power efficiency of the display plus driver combination.

In FIG. 3 the active matrix display 302 has a plurality of row electrodes 304*a-e* and a plurality of column electrodes 308*a-e* each connecting to internal respective row and column lines 306, 310 of which, for clarity, only two are shown. Power ($V_{ss}$) 312 and ground 318 connections are also provided, again connected to respective internal conducting traces 314 and 316 to provide power to the pixels of the display. For clarity a single pixel 320 is illustrated, connected as shown to $V_{ss}$, ground, row, and column lines 314, 316, 306, and 310. It will be recognised that in practice a plurality of such pixels is provided generally, but not necessarily, arranged in a rectangular grid and addressed by row and column electrodes 304, 308. The active matrix pixel 320 may comprise any conventional active matrix pixel driver circuit.

In operation each row of active matrix display 302 is selected in turn by appropriately driving row electrodes 304 and, for each row, the brightness of each pixel in a row is set by driving, preferably simultaneously, column electrodes 308 with brightness data. This brightness data as described above, may comprise either a current or a voltage. Once the brightnesses of the pixels in one row have been set the next row may be selected and the process repeated, the active matrix pixels including a memory element, generally a capacitor, to keep the row illuminated even when not selected. Once data has been written to the entire display, the display only needs to be updated with changes to the brightness of pixels.

Power to the display is provided by a battery 324 and a power supply unit 322 to provide a regulated $V_{ss}$ output 328. Power supply 322 has a voltage control input 326 to control the voltage on output 328. Preferably power supply 322 is a switch mode power supply with rapid control of the output voltage 328, typically on a microsecond time scale where the power supply operates at a switching frequency 1 MHz or greater. Use of a switch mode power supply also facilitates use of a low battery voltage which can be stepped up to the required $V_{ss}$ level, thus assisting compatibility with, for example low voltage consumer electronic devices.

The row select electrodes 304 are driven by row select drivers 330 in accordance with a control input 332. Likewise the column electrodes 308 are driven by column data drivers 334 in response to a data input 336. In the illustrated embodiment each column electrode is driven by an adjustable constant current generator 340, in turn controlled by a digital-to-analogue converter 338 coupled to input 336. For clarity only one such constant current generator is shown.

The constant current generator 340 has a current output 344 to source or sink a substantially constant current. The constant current generator 340 is connected to a power supply drive $V_{drive}$ 342, which may be equal and connected to $V_{ss}$ or which may be greater than (here, more negative than) $V_{ss}$ to allow active matrix pixel 320 to be driven harder than $V_{ss}$. The voltage for $V_{drive}$ may be provided, for example, by a separate output from power supply unit 322.

The embodiment of the display driver illustrated in FIG. 3 shows a current-controlled active matrix display in which a column electrode current to set a pixel brightness. It will be appreciated that a voltage-controlled active matrix display, in which the brightness of a pixel is set by the voltage on a column line, could also be employed by using voltage rather than current drivers for column data drivers 334.

The control input 332 of row select drivers 330 and the data input 336 of column data drivers 334 are both driven by display drive logic circuitry 346 which may, in some embodiments, comprise a microprocessor. The display drive logic 346 is clocked by a clock 348 and, in the illustrated embodiment, has access to a frame store 350. Pixel brightness and/or color data for display on display 302 is written to display drive logic 346 and/or frame store 350 by means of data bus 352.

The display drive logic has a sense input 356 driven from the output of a current sensing device 354. This may comprise, for example, an analogue-to-digital converter configured to sense the voltage drop across a resistor. This is used to monitor the current drawn by display 302 from output 328 of power supply 322. In embodiments in which a plurality of power supply lines are monitored a plurality of converters or a multiplexed converter may be employed. Optionally (but not shown in FIG. 3) the supply voltage $V_{ss}$ may also be monitored.

The display drive logic 346 (which may be implemented by a processor under stored program control or in hardware or in a combination of the two) includes a current sense unit 358 and a power controller 360 (in this example both implemented by processor control code stored in non-volatile memory). The current sense unit 358 inputs a current signal on sense input 356 and the power controller 360 outputs a voltage control signal to input 326 of power supply unit 322 to control power supply voltage $V_{ss}$ in response to the sensed input voltage. Operation of the power controller is described in more detail below with reference to FIG. 4.

Figure 4:
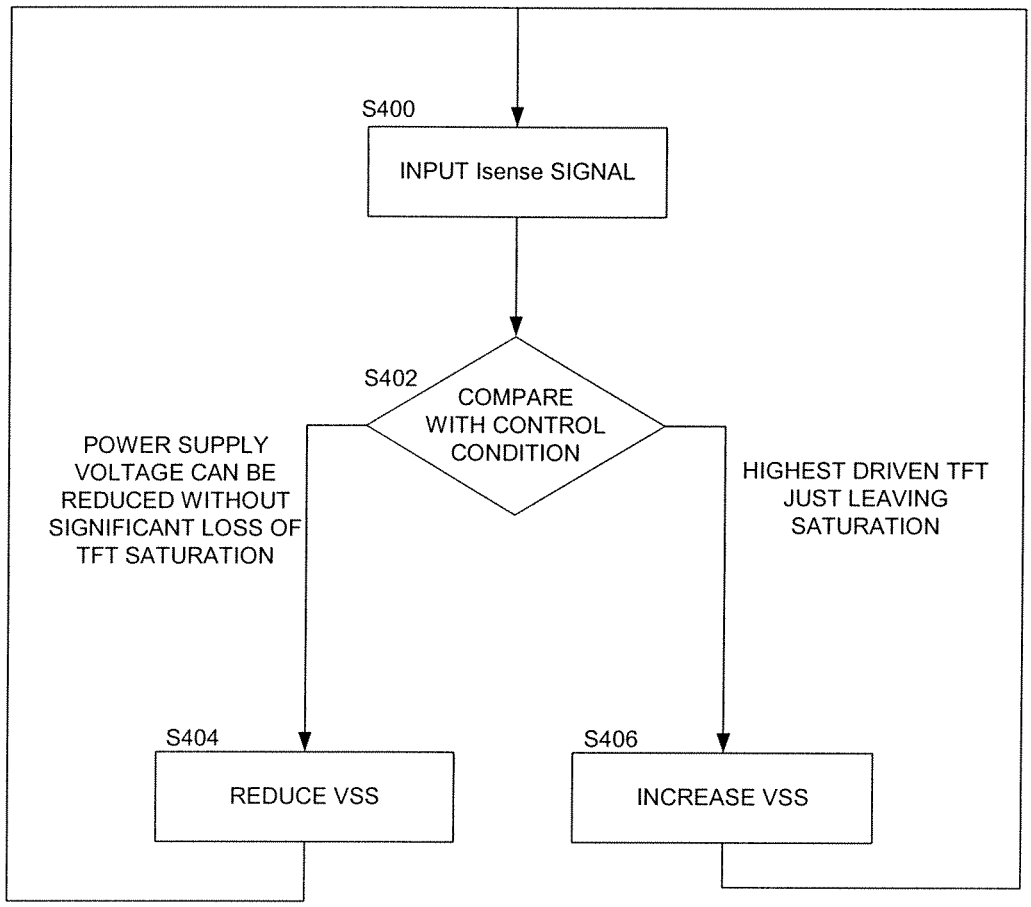
FIG. 4 shows a flow diagram of a power supply voltage control procedure for the driver of FIG. 3.

FIG. 4 shows a flow diagram of a procedure which may be implemented by power controller 360 in embodiments of a display driver for driving an active matrix display. The general procedure is suitable for both current- and voltage-programmed active matrix displays.

Referring to FIG. 4, the display controller 346, at step S400, inputs a current sense signal which it then compares (step S402) with a control condition. This control condition comprises a test to determine whether the current has begun to dip significantly and, in one embodiment, may therefore be implemented by determining a change in sensed current since a previous measurement, either in absolute terms or as a percentage, and then comparing this with a threshold such as two percent, five percent, ten percent.

If comparison with the control condition indicates that the power supply voltage can be reduced without significant loss of TFT driver transistor saturation, for example because the change in current is less than a pre-determined threshold, then at step S404 $V_{ss}$ is reduced and the procedure loops back to step S400. If, however, comparison with the control condition indicates that the one or more TFT driver transistors with the highest drive (which should be closest to saturation) are just leaving saturation then, at step S406, $V_{ss}$ is increased and the procedure again loops back to step S400.

The skilled person will appreciate that a variety of conditions will be employed as the control condition, depending upon the particular application. In embodiments where the active matrix display has two or more separate power supply lines, for example for two or more separate sub-pixels of the display then separate control loops are shown in FIG. 4, optionally with different control conditions, may be employed for each separate power supply lines.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of reducing the power consumption of an active matrix electroluminescent display, the method comprising:

controlling a power supply voltage to at least one pixel of the display, said power supply voltage being output from a power supply;

monitoring, via a current sensing device, a power supply current based on said power supply voltage, said current sensing device disposed between the power supply and the display;

wherein said current sensing device comprises an analogue-to-digital converter configured to sense voltage drop across a resistor, wherein said current sensing device directly provides input to a current sense input of a display drive logic for controlling said power supply voltage, wherein said controlling further comprises progressively reducing said power supply voltage until said power supply current reduces by greater than a threshold, wherein said active matrix electroluminescent display comprises a plurality of pixels each having a driver transistor, and wherein said monitoring and controlling comprises at least periodically monitoring said power supply current and controlling said power supply voltage to maintain said active matrix display in an operating region in which the driver transistor of the plurality of driver transistors having the highest drive level is just within saturation.

2. The method as claimed in claim 1 wherein said active matrix electroluminescent display is a multicolor display, each pixel of the display comprising at least first and second sub-pixels of different colors, said first and second sub-pixels having different respective power supply lines, and wherein the method comprises separate controlling and monitoring of each said sub-pixel power supply line.

3. The method as claimed in claim 1, wherein said active matrix electroluminescent display has a plurality of spatial sub-divisions, each said spatial sub-division having a separate respective power supply line, and wherein the method comprises separate said controlling and monitoring of each said spatial sub-division power supply line.

4. The method as claimed in claim 1 further comprising controlling a drive level to one or more pixels of said display to compensate for said power supply voltage reducing.

5. An active matrix OLED display comprising a plurality of pixels each with an OLED display element and an associated driver transistor, and a display driver as claimed in claim 4.

6. The active matrix OLED display as claimed in claim 5 wherein each said pixel comprises at least first and second sub-pixels of different colors, and wherein said two portions comprises said first and second sub-pixels respectively.

7. The active matrix OLED display as claimed in claim 5 wherein said portions include a plurality of spatially separate sub-divisions of said display.

8. The active matrix OLED display as claimed in claim 5 wherein said display comprises at least two portions with separate power supply lines for providing power to said driver transistor.

9. A non-transitory carrier comprising a computer readable storage medium having process control code stored thereon to implement the method of claim 1.

10. An active matrix display driver including the non-transitory carrier of claim 9.

11. The display driver as claimed in claim 10 wherein said active matrix electroluminescent display comprises an OLED display.

12. The non-transitory carrier as claimed in claim 9 wherein said active matrix electroluminescent display comprises an OLED display.

13. The method as claimed in claim 1 wherein said active matrix electroluminescent display comprises an OLED display.

14. An active matrix display driver, comprising a plurality of pixels, each pixel having a driver transistor, for driving an active matrix electroluminescent display, the driver comprising:

a controller for controlling a power supply voltage to at least one pixel of the display, said power supply voltage being output from a power supply;

a monitor for monitoring, via a current sensing device, a power supply current based on said power supply voltage, said current sensing device disposed between the power supply and the display;

wherein said current sensing device comprises an analogue-to-digital converter configured to sense voltage drop across a resistor, wherein said current sensing device directly provides input to a current sense input of a display drive logic for controlling said power supply voltage, wherein said controller progressively reduces said power supply voltage until said power supply current reduces by greater than a threshold, and wherein the monitor is operable to at least periodically monitor the power supply current and the controller is operable to control the power supply voltage to maintain the display in an operating region in which the driver transistor of the plurality of driver transistors having the highest drive level is just within saturation.

15. The active matrix display driver as claimed in claim 14 wherein said controller is configured to adjust said control signal to progressively reduce said sensed current to a threshold point.

16. The active matrix display driver as claimed in claim 15 wherein said controller is further configured to adjust said control signal to maintain said power supply in the vicinity of said threshold point.

17. The active matrix display driver as claimed in claim 16 wherein said threshold point comprises a point at which the driver transistor of the plurality of driver transistors having the highest drive level is just within saturation.

18. The active matrix display driver as claimed in claim 14 wherein said driver further comprises a voltage sensor to sense a voltage on said power supply line, wherein said controller further comprises a voltage sense input for said voltage sensor; and wherein said voltage control output is responsive to a sensed voltage signal on said voltage sense input.

19. The active matrix display driver as claimed in claim 14 in combination with a display having a plurality of power supply lines; wherein said driver is configured to provide a plurality of separately controllable power supplies to said plurality of power supply lines, and to sense current in said plurality of power supply lines; and wherein said controller is configured to separately control a power supply voltage on each of said plurality of power supply lines responsive to a current in the respective line.

20. A controller for a driver of an active matrix electroluminescent display, the display having a plurality of pixels each having an electroluminescent display element and an associated drive transistor, the display having a power supply line for providing power to the driver transistors of said pixels; the driver comprising a pixel data driver to drive said display pixels with data for display, a controllable voltage power supply to provide a power supply voltage to said power supply line, and a current sensing device to sense a current in said power supply line; the controller comprising:

a current sense input for said current sensing device, said current sense input being determined by the sensed current which is based on said power supply voltage, said current sensing device disposed between the power supply and the display;

a voltage control output for said controllable voltage power supply to provide power to at least one pixel of said display; and a voltage controller to provide a voltage control signal for said voltage control output responsive to a current sense signal from said current sense input, wherein said current sensing device comprising an analogue-to-digital converter configured to sense voltage drop across a resistor;

wherein said current sensing device directly provides input to said current sense input of a display drive logic for controlling said power supply voltage, wherein the voltage controller is operable to at least periodically monitor the current sense signal from the current sense input and the controller is operable to control the voltage control output for the controllable supply voltage to maintain the electroluminescent display in an operating region in which the driver transistor of the plurality of driver transistors having the highest drive level is just within saturation.

21. The controller as claimed in claim 20 further configured to adjust said pixel drive data in coordination with said voltage control signal.

22. An active matrix electroluminescent display driver including the controller of claim 20.

23. The controller as claimed in claim 20 wherein said active matrix electroluminescent display comprises an OLED display.

* * * * *